US006675864B2

(12) United States Patent
Singer et al.

(10) Patent No.: US 6,675,864 B2
(45) Date of Patent: Jan. 13, 2004

(54) METHOD FOR PRODUCING A COMPOSITE STRUCTURE WITH A FOAMED METAL CORE

(75) Inventors: Robert F. Singer, Erlangen (DE); Frank Heinrich, Spardorf (DE); Carolin Korner, Feucht (DE); Gerhard Grotzschel, Sternenfels (DE)

(73) Assignee: Friedrich-Alexander-Universitat-Erlangen-Nurngerg, Erlangen (DE)

( * ) Notice: Subject to any disclaimer, the term of this patent is extended or adjusted under 35 U.S.C. 154(b) by 0 days.

(21) Appl. No.: 10/204,400

(22) PCT Filed: Feb. 13, 2001

(86) PCT No.: PCT/DE01/00556

§ 371 (c)(1),
(2), (4) Date: Nov. 26, 2002

(87) PCT Pub. No.: WO01/62415

PCT Pub. Date: Aug. 30, 2001

(65) Prior Publication Data

US 2003/0141032 A1 Jul. 31, 2003

(30) Foreign Application Priority Data

Feb. 25, 2000 (DE) ..... 100 09 008

(51) Int. Cl.[7] ..... B22D 17/08; B22D 19/16; B22D 23/00; B22D 27/00

(52) U.S. Cl. ..... 164/79; 164/98; 164/113; 164/100

(58) Field of Search ..... 164/79, 113, 98–103, 164/111, 112

(56) References Cited

U.S. PATENT DOCUMENTS 5,685,358 A 11/1997 Kawasaki et al.

FOREIGN PATENT DOCUMENTS

| | | |
|---|---|---|
| DE | 195 01 508 C1 | 4/1996 |
| DE | 195 26 057 C1 | 4/1996 |
| EP | 0 344 010 A1 | 11/1989 |

OTHER PUBLICATIONS

WO 99/39923, Cast Wheel Rim, Publication Date: Aug. 12, 1999.

*Primary Examiner*—Kuang Y. Lin
(74) *Attorney, Agent, or Firm*—Rankin, Hill, Porter & Clark LLP

(57) ABSTRACT

A method for producing a composite structure in which a foamed metal core (1) is surrounded with a metal body (3). The method includes the following steps: a) producing a foamed metal core (1) with an essentially closed surface; b) introducing the foamed metal core (1) into a pressure die-casting mold; c) filling the pressure die-casting mold at a first casting pressure (p1); d) reducing the first casting pressure (p1) before the pressure die-casting mold has been filled; e) filling the pressure die-casting mold entirely, the first casting pressure (p1) being reduced to zero or almost zero; and f) applying a second casting pressure (p2) and maintaining the second casting pressure for a predetermined holding period.

10 Claims, 5 Drawing Sheets

3

1

2

METHOD FOR PRODUCING A COMPOSITE STRUCTURE WITH A FOAMED METAL CORE

The invention relates to a process for producing a composite structure in which a metal foam core is surrounded by a metal body. It also relates to a component produced using the process.

In accordance with the prior art, DE 195 26 057 has disclosed a process for producing a composite structure. In this process, the surface of a metal foam core is compacted with heating, so that only fine cracks and holes remain in the surface. Then, a thermal spraying process is used to apply a metal layer to the surface. In this process, the contour of the component is predetermined by the contour of the metal foam core. Complex contours cannot be produced or can only be produced with great difficulty.

DE 196 50 613 has disclosed a component with a metal foam core and a process for its production. The metal foam core is surrounded by a metal foil and then a casting material is cast around it. The metal foil has the purpose of preventing the molten material from penetrating into the pores of the metal foam core. The known process is complex, since the metal foam core has to be surrounded with the metal foil in such a manner that a seal is formed. This requires manual action.

It is an object of the invention to eliminate the drawbacks of the prior art. In particular, it is intended to describe a process for producing a composite structure which can be carried out as easily and inexpensively as possible.

A further aim of the invention is provide an automatable process for producing a composite structure.

This object is achieved by the features of claim 1. Expedient configurations will emerge from the features of claims 2–10.

The invention provides a process for producing a composite structure, in which a metal foam core (1) is surrounded by a metal body, comprising the following steps:

a) production of a metal foam core with a substantially continuous surface, b) insertion of the metal foam core into a die-casting die, c) filling of the die-casting die under a first casting pressure, d) reduction of the first casting pressure before the die-casting die has been filled, e) complete filling of the die-casting die, during which process the first casting pressure is reduce to zero or virtually zero, and f) application of a second casting pressure and holding of his pressure for a predetermined holding time.

The proposed process is simple and inexpensive to carry out. It is not absolutely imperative to provide a metal foil or the like to seal the surface pores of the metal foam. According to the invention, this is achieved in particular by the first pressure being reduced or lowered to zero or virtually zero, for example by reducing the piston advance velocity of the die-casting device, before the die-casting die has been completely filled. A pressure peak which occurs in the continuous die-casting process, in particular at the time of complete filing of the die-casting die, is avoided. It is assumed that this measure leads to the formation of a solidification layer on the surface of the metal foam core, which surprisingly, despite the subsequent application of a second casting pressure, prevents molten material from penetrating into the metal foam core.

The metal foam core is produced using known processes. For this purpose, by way of example, an alloy which has been mixed with a metal hydride, preferably a titanium hydride, and is in the form of sheet-metal strips, pieces or granules, is introduced into a closed die. The die is heated and in the process the alloy melts. The metal hydride releases gas and in the process produces foaming. A metal foam core which has been produced in this manner has a surface or skin which is substantially continuous, i.e. contains fine pores and cracks.

The term casting pressure is understood as meaning the pressure which prevails in the shot sleeve. The casting pressure generally differs from the pressure in the die-casting die acting on the metal foam core which is accommodated therein. This difference is brought about, for example, by the geometry of the die-casting die, e.g. its gate, or by dynamic effects, such as friction forces. The casting pressure is usually greater than the pressure which is thereby exerted on the metal foam core.

The first and/or second casting pressure is expediently applied in accordance with a predetermined pressure/time curve. This defines, for example, the rate at which the pressure increases, the second casting pressure and the holding time of this pressure.

According to an advantageous configuration, the first casting pressure is lower than the second casting pressure. The first casting pressure is expediently reduced as soon as the die-casting die is at least 90% full by volume. The pressure which is produced on the metal foam core by the second casting pressure is advantageously lower than its compressive strength. The pressure which is generated on the metal foam core by the first casting pressure is expediently less than 25 bar, and the pressure which is produced on the metal foam core by the second casting pressure is greater than 25 bar. The second casting pressure is preferably between 200 and 700 bar.

The first casting pressure is used to substantially completely fill the die-casting die. During this phase, the molten material is able to fill the main open volume of the die-casting die. In the process, no significant pressure is exerted on the metal foam core. The second casting pressure is only applied when the die casting die has been completely filled. The pressure produced by the second casting pressure acts on the metal body and the metal foam core. It is lower than the compressive strength of the metal foam core, in order not to destroy the structure of this core, and high enough to close up pores which have remained in the metal body.

According to a further configuration, spacers are formed integrally on the metal foam core. They are expediently designed as web-like elevations. This further simplifies the proposed process, makes it less expensive and creates additional design options for the component geometry.

According to a further design feature, there is provision for the metal foam core to be provided with a heat-resistant coating before step b). This coating can be produced by thermal spraying or by dipping into a ceramic slip. The thermal spraying may take place, for example, by means of flame spraying, e.g. aluminum wire flame spraying. As an alternative to wire flame spraying, it is also possible to use other high-speed flame spraying processes, for example vacuum plasma spraying. By way of example, the slip used may be a MgAl spinel slip. The slip adheres well to the surface of the metal foam core. The abovementioned features additionally prevent molten material from entering the pores at the surface of the metal foam core during the die-casting operation.

According to a further particularly advantageous configuration, a vacuum is applied to the die cavity surrounded by the die-casting die after step b). It is advantageous for the die cavity to be as evacuated as far as possible. Good results are achieved when a vacuum in the range from 5 to 50 mbar, preferably from 10 to 30 mbar, is applied to the die cavity. The vacuum is expediently applied to the die cavity until the die-casting die has been completely filled with molten material. The application of the vacuum can be disconnected by the molten material, when the die-casting die is completely full, penetrating into associated runners, where it closes a vacuum relief valve arranged there. The application of vacuum to the die-casting die allows simple and rapid production of substantially pore-free and defect-free components.

Further in accordance with the invention a component produced using the abovementioned process is claimed:

The process according to the invention is explained in more detail below with reference to an exemplary embodiment. In the drawing:

FIG. 1 shows the casting pressure and the piston speed plotted against time and displacement, FIG. 2 shows the compressive strength of aluminum metal foam specimens as a function of the density, FIG. 3 shows a metal foam core which has been surrounded with a wire flame-sprayed coating, FIG. 4 shows a metal foam core which has been surrounded with slip coating, FIG. 5 shows a sectional view of a composite structure which has been produced, FIG. 6 shows a plan view of a side of a component which has been produced under the action of a vacuum, FIG. 7 shows a plan view of the other side of the component shown in FIG. 6, FIG. 8 shows a plan view of a side of a further component produced without the use of a vacuum, and FIG. 9 shows a plan view of the other side of the component shown in FIG. 8.

In FIG. 1, the reference symbol p is used to indicate the casting pressure plotted against time. The casting pressure is specific to the die-casting device and die which is used in each case. In the present example, aluminum ha been cast around a metal foam core produced substantially from aluminum. As can be seen from FIG. 1, a first casting pressure pl during the filling of the die-casting die is less than 50 bar. Typically, it is initially approximately 20 bar. At a filling level of more than 90% by volume, preferably more than 98% by volume, the first casting pressure p1 is lowered by reducing the piston advance velocity and is reduced to zero or virtually zero. The die-casting die remains unpressurized in the completely filled state for a short time. It is assumed that during this period molten material solidifies at the surface of the metal foam core and pores and cracks which are present therein are closed up.

Then, a second casting pressure p2 of approximately 400 bar is applied at a constant rate. The pressure which is applied to the metal foam core by the second casting pressure p2 is lower than the compressive strength of the metal foam core. The second casting pressure p2 is held for a predetermined time. The second casting pressure p2 causes pores which have remained in the metal body surrounding the metal foam core to be closed up.

In addition, in FIG. 1 the piston advance velocity v of the die-casting device is plotted against displacement. The piston advance velocity v is expediently increased until a die-casting die filling level of approximately 80% by volume is reached. This leads to particularly effective filling of the die-casting die. Then, the piston advance velocity v remains constant up to a filling level of at least 90% by volume. The piston advance velocity v is reduced to zero or virtually zero when a filling level of at least 90% by volume, preferably of 98% by volume, is reached. The die-casting die remains unpressurized for a short time, before the second casting pressure p2 of approximately 400 bar is applied by a short further advance of the piston.

FIG. 2 shows the compressive strength of Al metal foam specimens plotted against the density. The figure shows a comparison of Al metal foam specimens of an Al metal foam plate which has been produced from a wrought alloy and Al metal foam specimens of an Al metal foam plate which has been produced from a cast alloy. In typical density ranges of from 0.6 to 0.7 g/cm$^3$, the compressive strength of the Al metal foam specimens of the two alloys is between 7 and 10 MPa. The Al metal foam plate produced on the basis of a wrought alloy has a slight scatter with regard to its density and compressive strength.

Figure 1:
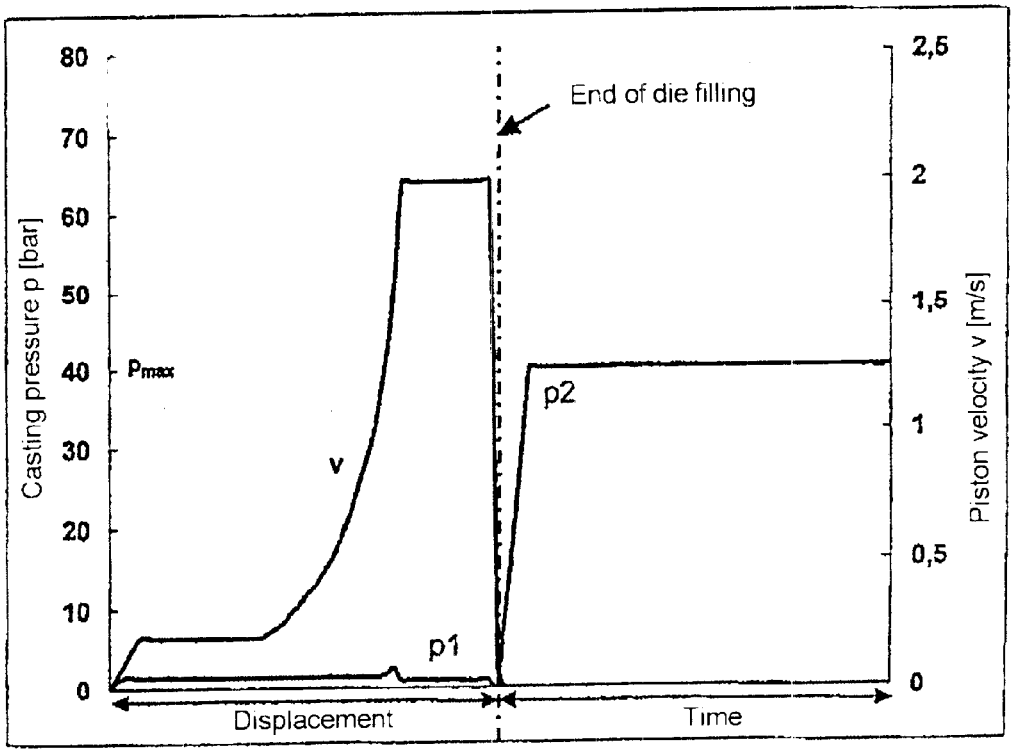
Figure 2:
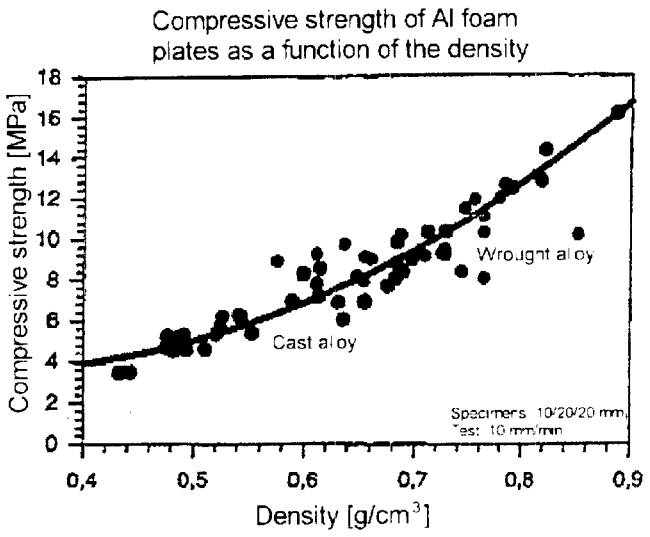
Figure 3:
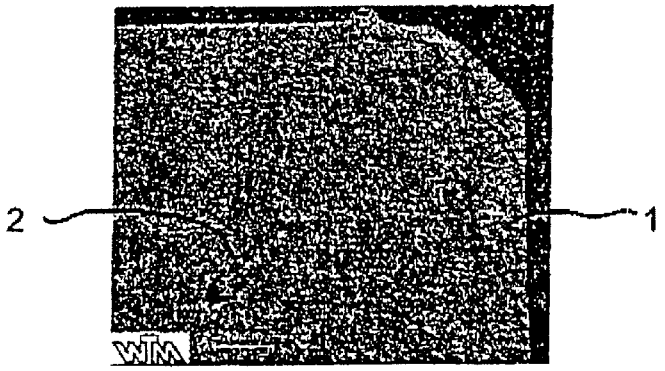
FIG. 3 shows a metal foam core 1 which has been surrounded by an Al wire flame-sprayed coating. 2 indicates a web-like spacer which has been produced integrally with the metal foam core 1 produced from aluminum.
Figure 4:
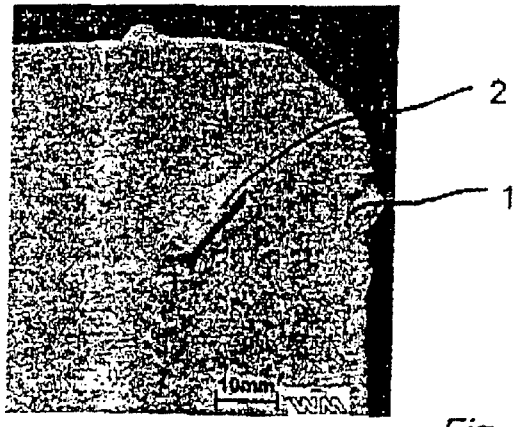
FIG. 4 shows a metal foam core 1 which has been surrounded by a ceramic slip coating. The slip coating has in this case been produced from an MgAl spinel.
Figure 5:
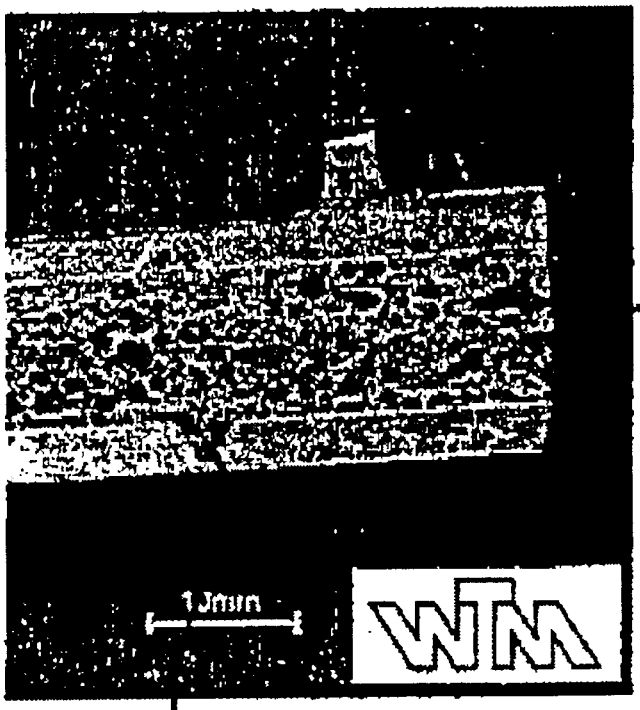

FIG. 5 shows a composite structure in which the metal foam core 1 with the spacers 2 formed thereon has been surrounded by a metal body 3. The metal body 3, like the metal foam core 1, is produced from an aluminum alloy.

Figure 6:
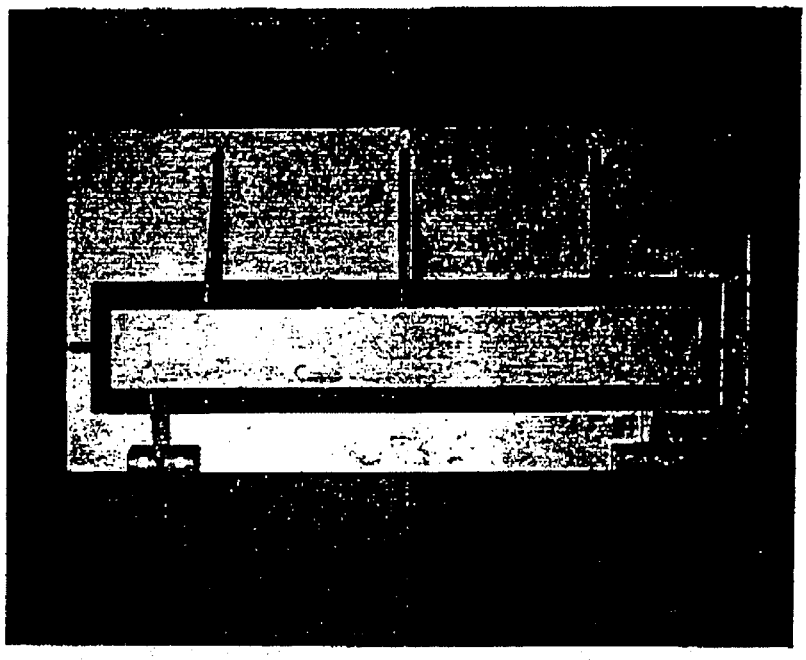
Figure 7:
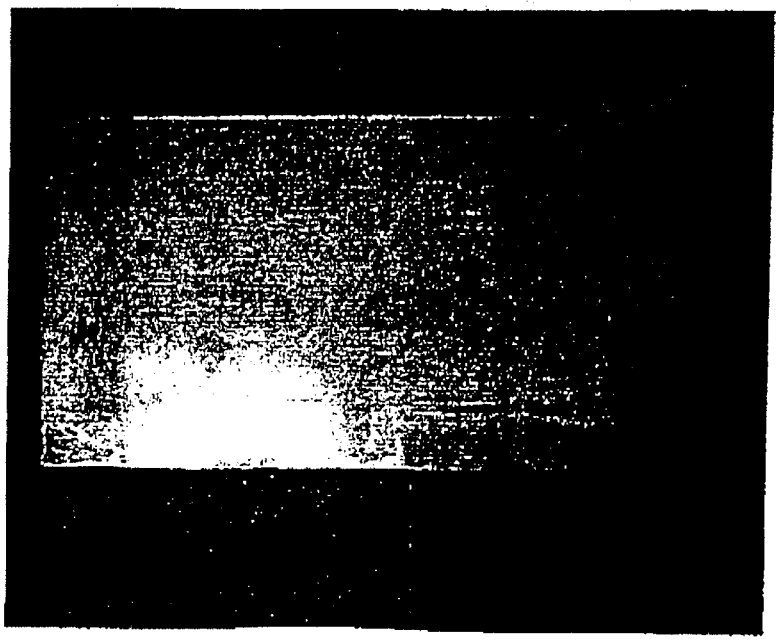

FIGS. 6 and 7 show a component which has been produced using the process according to the invention with the application if a vacuum. After the metal foam core has been inserted into the die-casting die, the latter is closed in a substantially vacuum-tight manner. The die cavity surrounded by the die-casting die is exposed to a vacuum of approximately 10 mbar using a suitable device. The application of a vacuum lasts until the molten material has completely filled the die cavity. During the complete filling of the die cavity, the molten material expediently penetrates into suitable runners leading from the cavity, where it closes a vacuum valve. The application of a vacuum to the die cavity allows the process to be carried out at lower pressures compared to conventional die-casting processes. As can be seen from a comparison of FIGS. 6 to 9, components produced under the application of a vacuum have significantly better cast qualities with a lower porosity. The filling of the die is better when a vacuum is applied to the die cavity.

The components shown in FIGS. 6 to 9 have each been produced using identical casting parameters. The pressure in the casting chamber was in each case 500 bar, and the maximum die-filling rate was in each case 3.7 m/s The component shown in FIGS. 6 and 7 has been cast with the application of a vacuum of approximately 30 mbar to the die cavity.

Figure 8:
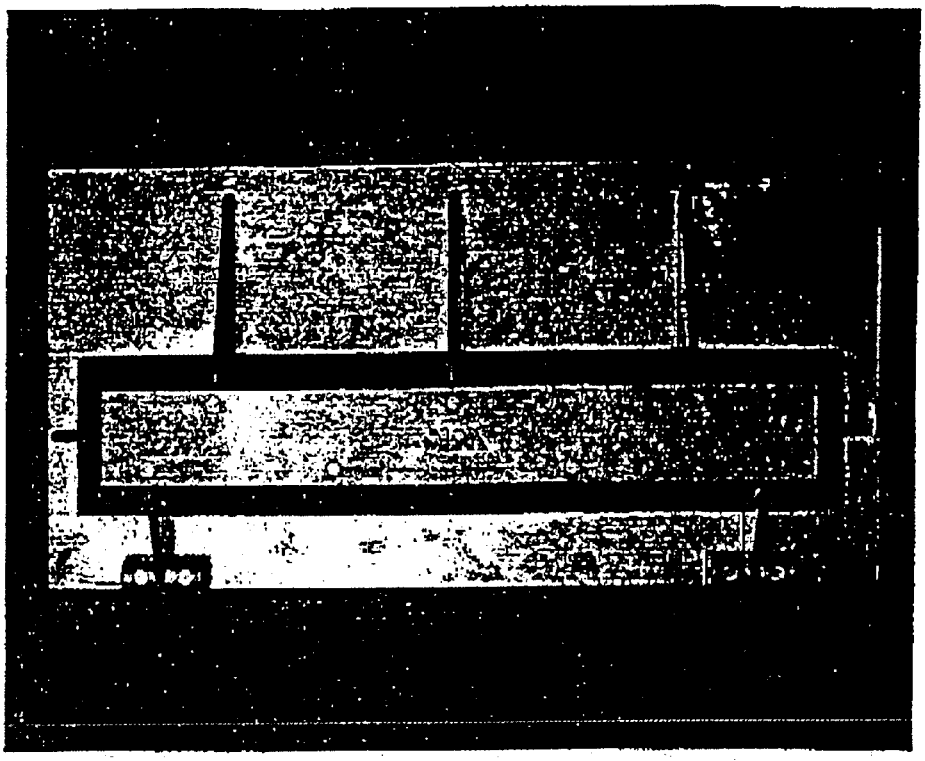
Figure 9:
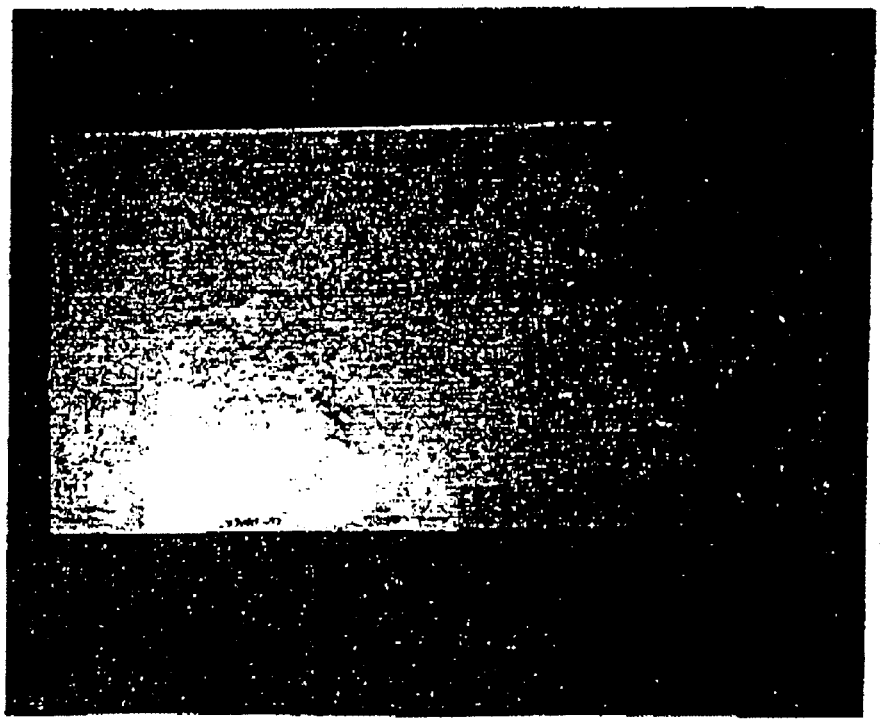

The component shown in FIGS. 8 and 9 has been cast without applying a vacuum to the die cavity.

What is claimed is:

1. A process for producing a composite structure in which a metal foam core (1) is surrounded by a metal body (3), comprising the following steps:

a) providing a metal foam core (1) with a substantially continuous surface, b) inserting the metal foam core (1) into a die-casting die, c) filling the die-casting die under a first casting pressure (p1), d) reducing the first casting pressure (p1) before the die-casting die has been filled, e) completing filling of the die-casting die, during which the first casting pressure (p1) is reduced to approximately zero, and f) applying a second casting pressure (p2) to the die-casting die and holding said second casting pressure for a predetermined holding time.

2. The process as claimed in claim 1, wherein at least one of the first casting pressure (p1) and the second casting pressure (p2) is applied in accordance with a predetermined pressure/time curve.

3. The process as claimed in claim 1, wherein the first casting pressure (p1) is lower than the second casting pressure (p2).

4. The process as claimed in claim 1, wherein the first casting pressure (p1) is reduced when the die-casting die is at least 90% full by volume.

5. The process as claimed in claim 1, wherein the pressure applied to the metal foam core (1) by the second casting pressure (p2) is lower than a compressive strength of said metal foam core.

6. The process as claimed in claim 1, wherein spacers (2) are formed integrally onto the metal foam core (1).

7. The process as claimed in claim 1, wherein the metal foam core (1) is provided with a heat-resistant coating before step b).

8. The process as claimed in claim 7, wherein the heat-resistant layer is produced by one of thermal spraying or by dipping into a ceramic slip.

9. The process as claimed in claim 7, wherein the heat-resistant layer is selected from the group consisting of aluminum and Al/Mg mixed oxide.

10. The process as claimed in claim 1, wherein the die cavity surrounded by the die-casting die is subjected to a vacuum after step b).

* * * * *